US007458467B2

(12) United States Patent
Grönstrand et al.

(10) Patent No.: US 7,458,467 B2
(45) Date of Patent: Dec. 2, 2008

(54) STATOR FOR A FLOTATION CELL

(75) Inventors: Sami Grönstrand, Espoo (FI); Raimo Airola, Espoo (FI); Seppo Ronkainen, Kauniainen (FI)

(73) Assignee: Outotec Oyj, Espoo (FI)

( * ) Notice: Subject to any disclaimer, the term of this patent is extended or adjusted under 35 U.S.C. 154(b) by 57 days.

(21) Appl. No.: 10/598,757

(22) PCT Filed: Mar. 31, 2005

(86) PCT No.: PCT/FI2005/000168

§ 371 (c)(1),
(2), (4) Date: Sep. 11, 2006

(87) PCT Pub. No.: WO2005/097334

PCT Pub. Date: Oct. 20, 2005

(65) Prior Publication Data

US 2007/0181468 A1 Aug. 9, 2007

(30) Foreign Application Priority Data

Apr. 6, 2004 (FI) ..... 20040498

(51) Int. Cl.
*B03D 1/16* (2006.01)

(52) U.S. Cl. ..... 209/169; 209/168

(58) Field of Classification Search ..... 209/169, 209/168

See application file for complete search history.

(56) References Cited

U.S. PATENT DOCUMENTS

| | | | | |
|---|---|---|---|---|
| 2,190,852 | A * | 2/1940 | Tucker | 261/93 |
| 2,767,964 | A | 10/1956 | Potts | |
| 2,875,897 | A * | 3/1959 | Booth | 209/169 |
| 3,041,050 | A | 6/1962 | Nelson et al. | |
| 4,062,526 | A | 12/1977 | Green | |
| 4,551,285 | A * | 11/1985 | Jackson | 261/87 |
| 4,800,017 | A * | 1/1989 | Krishnaswamy et al. | 210/219 |

FOREIGN PATENT DOCUMENTS

| | | |
|---|---|---|
| DE | 1209971 | 2/1966 |
| EP | 287251 | 10/1988 |
| RU | 2187380 | 8/2002 |
| SU | 1273174 | * 11/1986 |

* cited by examiner

*Primary Examiner*—Thomas M Lithgow
(74) *Attorney, Agent, or Firm*—Smith-Hill and Bedell

(57) ABSTRACT

The invention relates to a stator for a flotation cell to be used in the flotation of slurry-like material, such as ore and concentrate containing valuable minerals, by means of which stator the orientation of the slurry flow created by the flotation cell rotor can be controlled. The stator is composed of at least three structural elements to be installed around the rotor provided with at least one flow regulator.

7 Claims, 2 Drawing Sheets

STATOR FOR A FLOTATION CELL

Figure 1:
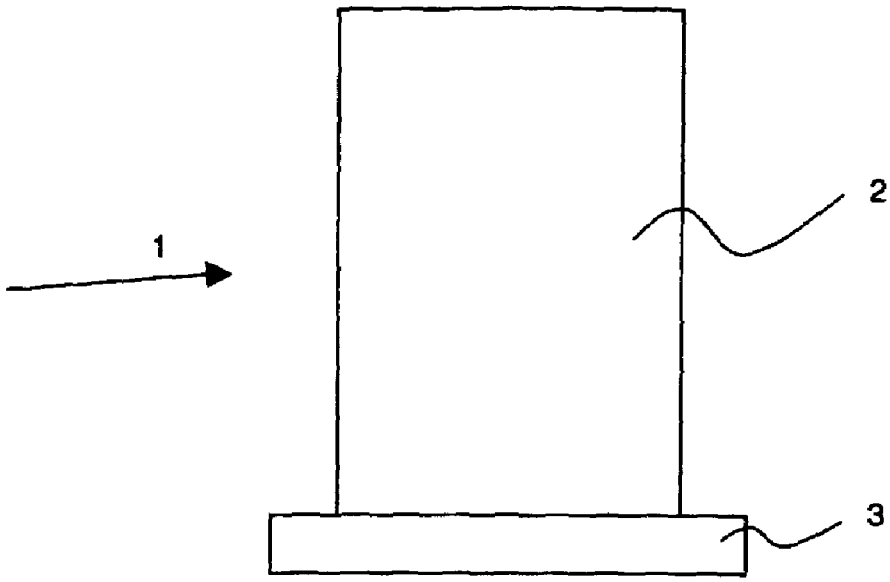

This is a national stage application filed under 35 U.S.C. 371 based on International Application No. PCT/FI2005/000168 filed Mar. 31, 2005, and claims priority under 35 U.S.C. 119 of Finnish Patent Application No. 20040498 filed Apr. 6, 2004.

The present invention relates to a stator for a flotation cell to be used in the flotation of slurry-like material, such as ore and concentrate containing valuable minerals, by which stator the slurry flow created by the rotor of the flotation cell can be advantageously directed towards at least one of the flow regulating members of the stator, so that the slurry jet is prevented from flowing directly through the stator.

A flotation machine used in the recovery of valuable ingredients usually includes a flotation cell provided with an inlet aperture for feeding slurry into the cell, and an outlet aperture for the non-flotatable material to be discharged from the flotation cell. The air needed for creating froth is fed through a hollow, rotatable axis, which axis is connected to an agitator element that agitates the slurry in order to keep it in suspension. When the rotor serving as the agitator rotates, air is fed in the slurry, and air bubbles are dispersed in the slurry. The stator installed around the rotor guides the circulations of the suspension formed by slurry and air. In addition, reagents are fed into the flotation cell, which reagents are then attached onto the surface of the valuable particles that are contained in the slurry and should be recovered. The reagents make the valuable particles hydrophobic and thus enhance the valuable particles to be attached to air bubbles. As the valuable particles are attached to the air bubbles, the particles start to rise upwards, towards the free top surface of the flotation cell, and there form a stabile froth bed.

For example the U.S. Pat. No. 5,039,400 and the PCT patent applications 01/43881 and 01/49388 describe a flotation cell used for flotating ore and concentrate containing valuable minerals, wherein a stator is installed around the rotor. The stator includes spaced-apart flow regulating members that are interconnected at least by a frame structure provided at the bottom part of the regulating members. This kind of a stator formed of flow regulating members and a frame is manufactured of one piece, and consequently, as the flotation cell sizes have grown, also the stator has become an essentially large object that is heavy and troublesome to handle, which as such increases expenses.

The object of the present invention is to eliminate drawbacks of the prior art and to realize an improved stator for a flotation cell used in the flotation of valuable minerals, which stator is easier to handle and is composed of structural elements including one or several flow regulating elements of the stator. The essential novel features of the invention are apparent from the appended claims.

A flotation cell stator with a modular structure according to the invention comprises at least three structural elements included in at least one flow regulator. The stator is advantageously composed of essentially identical structural elements, but the stator can also be composed so that the stator includes different structural parts provided with different numbers of flow regulators. The structural elements of the stator can also be arranged so that the structural elements are placed on top of each other, on two different levels. In addition, by changing the number of the structural elements of the stators, it is possible to provide stators that are by volume suitable for different sizes of flotation cells. Irrespective of the size of the flotation cell stator according to the invention, the structural elements are mutually arranged so that the tangential slurry jet emitted from the flotation cell rotor can be directed preferably towards at least one flow regulator of the stator in order to prevent the slurry jet from flowing directly through the stator.

In cross-section, the flow regulator of the stator according to the invention of a flotation cell with a modular structure is preferably oval-shaped or elliptical or even rectangular, where the ratio of the larger dimension to the smaller is preferably at least bigger than three. The flow regulator is provided with a supporting structure, whereby the flow regulator can be attached to the flotation cell or to a separate stator fastening structure installed in the flotation cell, so that the flow regulator can be advantageously aligned with respect to the rotor provided in the flotation cell. The flow regulator and the connected supporting structure constitute a single structural element of the stator according to the invention. By combining said structural elements, there is obtained a stator of the desired size.

One or several flow regulators can be connected to a supporting structure provided in a single structural element of the stator. From the point of view of the manufacturing and treatment of the structural element, it is advantageous that the number of flow regulators provided in each supporting structure is no more than five. According to a preferred embodiment of the invention, three flow regulators are connected to each supporting structure, so that the flow regulator placed in the middle is located essentially equidistantly from the two other flow regulators. In addition, in cross-section the middlemost flow regulator is advantageously different from the two other flow regulators, so that the ratio of the larger and smaller dimensions of the cross-section is smaller than in the two other flow regulators. Now, when installing the structural element around the rotor of the flotation cell, that edge of the middlemost flow regulator that is nearest to the rotation axis of the rotor is arranged, in the radial direction, at an essentially equal distance from the rotation axis as the corresponding edge of the two other flow regulators.

When the supporting structure includes only one flow regulator, this kind of structural element of the stator can advantageously be manufactured in one piece, for example by casting. A structural element including one flow regulator can also be manufactured so that both the flow regulator and the supporting structure to be connected thereto are manufactured separately, for example by casting, hot extrusion or even by forging. Thereafter the flow regulator is connected to the supporting structure by welding or soldering or even mechanically, for instance by a screw joint.

When several flow regulators should be installed in the supporting structure, both the flow regulators and the supporting structure are advantageously manufactured separately and connected to the supporting structure of the flow regulators in a similar way as in the case of one single flow regulator. However, when desired, a structural element of the stator containing two or more flow regulators can also be manufactured as one piece, for example by casting. When several flow regulators are arranged in one and the same supporting structure, the flow regulators can also be interconnected at that end of the flow regulators that is opposite with respect to the supporting structure, in which case in that end of the flow regulators that is opposite to the supporting structure, there is attached for example a connecting element that is essentially similar to the supporting structure. The connecting element arranged at the end opposite to the supporting structure can also be essentially different from the supporting structure; for instance, it can be a connecting element that is essentially thinner and lighter than the supporting structure. The flow regulators interconnected at the end opposite to the supporting structure are better resistant to the strains caused by the solids-containing slurry treated in the flotation cell.

When manufacturing, according to the invention, the structural element of the stator, made of one or several flow regulators and supporting material, as well as possibly of a connecting element attached at the end opposite to the supporting structure of the flow regulator, the desired final structural element is coated for example by rubber lining, in order to make the structural element better resistant to the wearing effects of the slurry material treated in the flotation cell and containing solids, such as valuable metals.

Figure 2:
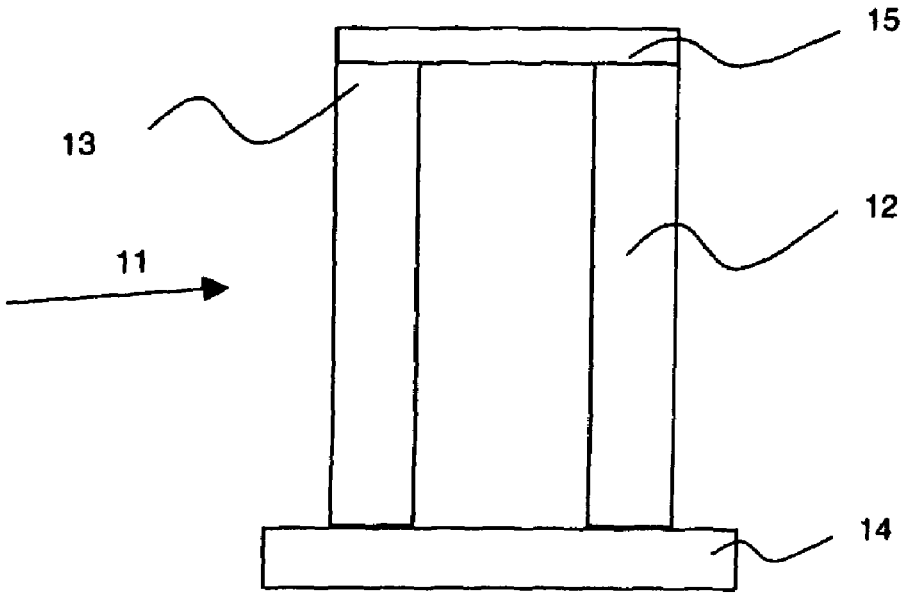
Figure 3:
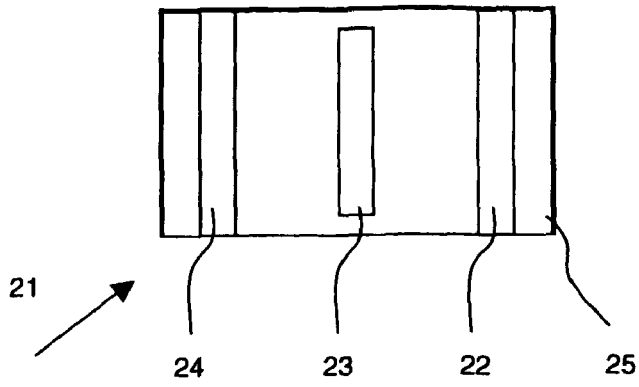
Figure 4:
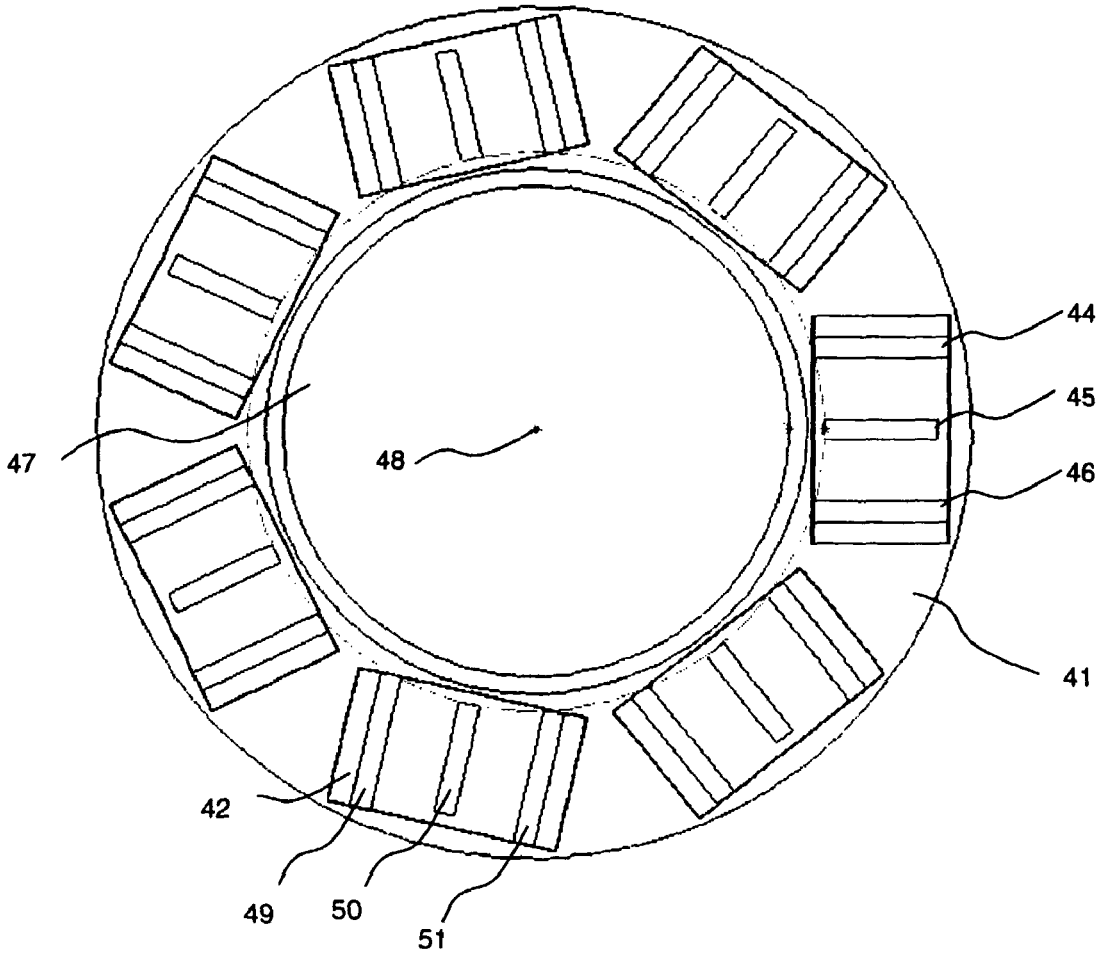

The invention is described in more detail below, with reference to the appended drawings, where FIG. 1 is a schematical side-view illustration of a preferred embodiment of the invention, FIG. 2 is a schematical side-view illustration of another preferred embodiment of the invention, FIG. 3 is a schematical top-view illustration of a preferred embodiment of the invention, and FIG. 4 is a schematical top-view illustration of a stator according to the invention, composed of structural elements.

According to FIG. 1, the structural element 1 of the stator, used in a flotation cell, is formed of one flow regulator 2 and of a supporting structure 3 attached to the other end of the flow regulator 2, whereby the flow regulator 2 can be connected to the flotation cell or to a stator fastening structure installed in the flotation cell. The flow regulator 2 and the supporting structure 3 are further both coated by a wear-resistant rubber lining.

The structural element 11 of the stator illustrated in FIG. 2 includes two flow regulators 12 and 13. At the other end, the flow regulators 12 and 13 are interconnected by a supporting structure 14 common to the flow regulators 12 and 13, by means of which supporting structure 14 the flow regulators 12 and 13 can be connected to the flotation cell or to a stator fastening structure installed in the flotation cell. At that end of the flow regulators 12 and 13 that is opposite to the supporting structure 14, there is installed a connecting element 15, whereby the flow regulators 12 and 13 are also interconnected. The structural element 11 composed of the flow regulators 12 and 13, the supporting structure 14 and the connecting element 15 is manufactured by casting, preferably in one piece.

According to FIG. 3, the stator structural element 21 used in a flotation cell includes three flow regulators 22, 23 and 24. At one end, the flow regulators 22, 23 and 24 are interconnected by a supporting structure 25. By means of the supporting structure 25, the flow regulators 22, 23 and 24 can be advantageously interconnected to the flotation cell or to a stator fastening structure installed in the flotation cell. With respect to the supporting structure 25, the flow regulators 22, 23 and 24 are installed so that the middlemost flow regulator 23 is located at an essentially equal distance both from the flow regulator 22 and from the flow regulator 24. In cross-section, the flow regulators 22 and 24 are designed to be essentially identical. On the other hand, the middlemost flow regulator 23 differs from the flow regulators 22 and 24 in cross-section, so that in the middlemost flow regulator 23, the ratio of the larger dimension to the smaller dimension is smaller than in the cross-section of the flow regulators 22 and 24.

The stator 41 illustrated in FIG. 4 is composed of structural elements 42 according to the invention, each of which elements includes three flow regulators 44, 45 and 46 arranged in the same supporting structure 43. The structural elements 42 are arranged around the rotor 47 of the flotation cell, so that the edges 49, 50 and 51 of the flow regulators 44, 45 and 46 placed nearest to the rotor rotation axis 48 are located at an essentially equal distance from the rotor rotation axis 48.

The invention claimed is:

1. A flotation cell for use in the flotation of slurry-like material, such as ore and concentrate containing valuable minerals, the flotation cell comprising:

a rotor mounted to rotate about an axis, and a stator including at least three structural elements angularly spaced apart around the rotor, wherein each structural element has first and second opposite ends and comprises at least two flow regulators, a supporting structure that is attached to and interconnects the flow regulators at the first end of the structural element and by which the structural element is connected to the flotation cell or to a stator fastening structure in the flotation cell, and a connecting element interconnecting the flow regulators at the second end of the structural element, the flow regulators of each structural element are disposed substantially parallel to each other, and a structural element is manufactured by separately casting the flow regulators, the supporting structure and the connecting element, assembling the flow regulators, the supporting structure and the connecting element to form the structural element, and interconnecting the flow regulators, the supporting structure and the connecting element by welding.

2. A flotation cell according to claim 1, wherein the flow regulators of each structural element are interconnected by the supporting structure, which is attached to the flow regulators at one end of the structural element.

3. A flotation cell according to claim 1, wherein the flow regulators of each structural element are identical in cross-section.

4. A flotation cell according to claim 1, wherein at least two flow regulators of each structural element are different in cross-section.

5. A flotation cell according to claim 1, wherein each flow regulator has an inner edge and an outer edge, the inner edge of the flow regulator is closer to the axis of rotation of the rotor than the outer edge, each structural element includes one flow regulator of which the inner edge is closer to said axis of rotation than the inner edge of another flow regulator of that structural element, and the structural elements are positioned around the rotor so that for each structural element the inner edge that is nearest the axis of rotation is at substantially the same distance from said axis of rotation as the inner edge of the flow regulator of another structural element.

6. A flotation cell according to claim 1, wherein the stator is composed of structural elements installed on two different levels around the rotor.

7. A flotation cell according to claim 1, wherein the structural elements are positioned around the rotor so that a tangential slurry jet emitted from the rotor is directed towards at least one flow regulator in order to prevent the slurry jet from flowing directly through the stator.

* * * * *